US006993147B2

(12) United States Patent
Guenther

(10) Patent No.: US 6,993,147 B2
(45) **Date of Patent: *Jan. 31, 2006**

(54) LOW COST BROAD RANGE LOUDSPEAKER AND SYSTEM

(76) Inventor: Godehard A. Guenther, 75 Folsom St., San Francisco, CA (US) 94105

( * ) Notice: Subject to any disclaimer, the term of this patent is extended or adjusted under 35 U.S.C. 154(b) by 0 days.

This patent is subject to a terminal disclaimer.

(21) Appl. No.: 10/403,830

(22) Filed: Mar. 31, 2003

(65) Prior Publication Data

US 2004/0071308 A1 Apr. 15, 2004

Related U.S. Application Data

(63) Continuation of application No. 09/639,416, filed on Aug. 14, 2000, now Pat. No. 6,654,476.

(51) Int. Cl.
*H04R 25/00* (2006.01)

(52) U.S. Cl. ..... 381/407; 381/409; 381/410; 381/412; 381/415; 381/419

(58) Field of Classification Search ..... 381/401, 381/402, 407–410, 412, 415, 419
See application file for complete search history.

(56) References Cited

U.S. PATENT DOCUMENTS

| | | | | |
|---|---|---|---|---|
| 2,769,942 A | | 11/1956 | Hassan | |
| 3,067,366 A | | 12/1962 | Hofman | |
| 3,340,604 A | | 9/1967 | Parain | |
| 3,838,216 A | | 9/1974 | Watkins | |
| 3,910,374 A | | 10/1975 | Holehouse | |
| 3,948,346 A | | 4/1976 | Schindler | |
| 3,979,566 A | | 9/1976 | Willy | |
| 4,122,315 A | | 10/1978 | Schroeder et al. | |
| 4,151,379 A | | 4/1979 | Ashworth | |
| 4,201,886 A | | 5/1980 | Nagel | |
| 4,220,832 A | | 9/1980 | Nagel | |
| 4,300,022 A | | 11/1981 | Hastings-James et al. | |
| 4,401,857 A | | 8/1983 | Morikawa | |
| 4,440,259 A | | 4/1984 | Strohbeen | |
| 4,472,604 A | | 9/1984 | Nakamura et al. | |
| 4,477,699 A | | 10/1984 | Wada et al. | |
| 4,492,826 A | | 1/1985 | Chiu | |
| 4,552,242 A | | 11/1985 | Kashiwabara | |
| 4,565,905 A | | 1/1986 | Nation | |
| 4,577,069 A | | 3/1986 | Keezer | |
| 4,591,667 A | * | 5/1986 | Hino et al. | 381/407 |
| 4,783,824 A | | 11/1988 | Kobayashi | |
| 4,799,264 A | * | 1/1989 | Plummer | 381/346 |
| 4,821,331 A | | 4/1989 | Murayama et al. | |
| 4,965,837 A | | 10/1990 | Murayama et al. | |
| 5,008,945 A | * | 4/1991 | Murayama et al. | 381/409 |
| 5,014,323 A | * | 5/1991 | Markow et al. | 381/409 |

(Continued)

*Primary Examiner*—Cutris Kuntz
*Assistant Examiner*—Dionne Harvey
(74) *Attorney, Agent, or Firm*—David J. Powsner; Nutter McClennen & Fish LLP

(57) ABSTRACT

A loudspeaker has a diaphragm with a voice coil disposed about its perimeter and extending in a gap into which the flux of an annular rare earth magnet is focused. An opening behind the diaphragm communicates through the speaker frame. The voice coil may have two or more windings that are connected in parallel, and may, e.g., be layered on top of one another, so that the impedance of the coil, as well as its depth in the front/back direction of motion, are low. The voice coil is preferably implemented using a polyamide form or bobbin, which has patterned lead-in conductors embedded therein to bring power to wire windings on the perimeter of the coil. The lead-in conductors extend to, or through, the central opening of a ring magnet, providing a robust ribbon input connection.

17 Claims, 4 Drawing Sheets

U.S. PATENT DOCUMENTS 5,027,412 A * 6/1991 Hayashi et al. ..... 381/409
5,040,221 A 8/1991 Edwards et al.
5,115,884 A 5/1992 Falco
5,155,578 A 10/1992 Lim et al.
5,249,236 A * 9/1993 Sakamoto ..... 381/409
5,333,204 A 7/1994 Hamada et al.
5,390,257 A 2/1995 Oslac et al.
5,402,503 A 3/1995 Prokisch
5,446,797 A 8/1995 Paddock
5,519,178 A 5/1996 Ritto et al.
5,524,151 A 6/1996 Bleim
5,548,657 A 8/1996 Fincham
5,583,945 A 12/1996 Iijima et al.
5,587,615 A 12/1996 Murray et al.
5,594,805 A 1/1997 Sakamoto et al.
5,604,815 A * 2/1997 Paddock ..... 381/396
5,657,392 A 8/1997 Bouchard
5,715,324 A 2/1998 Tanabe et al.
5,717,775 A * 2/1998 Sakamoto et al. ..... 381/400
5,744,761 A * 4/1998 Ogura et al. ..... 181/167
5,748,760 A 5/1998 Button
5,751,828 A 5/1998 Ueda et al.
5,802,189 A 9/1998 Blodget
5,802,191 A 9/1998 Guenther
5,835,612 A 11/1998 Fujihira et al.
5,847,333 A 12/1998 D'Hoogh
5,867,583 A 2/1999 Hazelwood et al.
5,898,786 A 4/1999 Geisenberger
5,909,015 A 6/1999 Yamamoto et al.
5,909,499 A 6/1999 Tanabe
5,916,405 A 6/1999 Ritto et al.
5,917,922 A 6/1999 Kukurudza
5,960,095 A 9/1999 Chang
6,005,957 A 12/1999 Meeks
6,047,077 A * 4/2000 Larsen ..... 381/412
6,067,364 A 5/2000 Brinkley et al.
6,208,743 B1 3/2001 Marten et al.
6,269,168 B1 * 7/2001 Tagami ..... 381/412
6,654,476 B1 * 11/2003 Guenther ..... 381/407

* cited by examiner

LOW COST BROAD RANGE LOUDSPEAKER AND SYSTEM

REFERENCE TO RELATED APPLICATIONS

This application is related to U.S. patent application Ser. No. 09/439,416, filed Nov. 13, 1999, which is hereby incorporated herein by reference in its entirety. This application is a continuation of U.S. Ser. No. 09/639,416, filed Aug. 14, 2000 now U.S. Pat. No. 6,654,476. This application claims the benefit of Provisional Application No. 60/148,863, filed Aug. 13, 1999.

BACKGROUND OF THE INVENTION

The invention relates to loudspeakers and to low-cost magnetic motors for use in loudspeakers. The invention has application, among other places, in portable consumer electronics, in cell phones, pagers, digital music players, and other apparatus where weight and size are factors. It has particular utility in applications that rely upon a main power source having a relatively low voltage, e.g., between about three to approximately twelve volts, and in further aspects provides compact full range systems.

A large percentage of loudspeakers are electrodynamic speakers. Such speakers employ a magnetic driver to produce movement of a diaphragm (typically cone or dome-shaped sheet) which, in turn, causes sound. A typical loudspeaker includes a permanent magnet arranged to define a gap, and a voice coil positioned in the gap to which an audio-frequency signal is applied. The magnet may be mounted toward the rear of the frame, behind the diaphragm, and may utilize a magnetic circuit formed by one or more pole pieces arranged to define a high-flux gap, with the magnetic field focused or intensified in the gap. The voice coil is disposed adjacent the magnet, typically within the air gap, and may consist of conductive leads or wire formed about a cylindrical support or bobbin that is attached to the diaphragm.

In operation, electrical audio signals from an amplifier are applied to the voice coil producing a varying electromagnetic field around the coil which interacts with the magnetic field produced by the permanent magnet. The magnet is securely fixed to the frame and the voice coil is movable, so the voice coil moves as the two fields interact. Because the voice coil is coupled to the diaphragm via the support, its movement causes the diaphragm to vibrate. The vibration of the diaphragm causes air around the speaker to pressurize and depressurize producing sound waves in the air.

The high energy density of rare earth materials such as neodymium boron iron is attractive for creating and miniaturizing shielded loudspeaker magnets. The magnet rings or discs may be installed as cores on the inside of the voice coil for easy manufacturing, and the high fluxes allow high maximum levels of storable and extractable energy, so that such speakers may be efficiently driven.

However, the physics of sound generation, as well as the resistance or inductance of the coil tend to limit the frequency response and quality of sound achievable as the speaker size gets smaller. To some extent, one can compensate for non-linearities of response by compensating the gain of the drivers as a function of frequency. However, when one adds the constraint of using a low operating voltage, then the sharp drop in driving efficiency at the low end of the spectrum, and the increase in voice coil impedance at the high end, would seem to impose severe limitations on effectiveness of the technique of correction by drive power compensation.

Thus it would be desirable to provide improved small loudspeakers, with more uniform and/or extended response.

An object of this invention is to provide an improved loudspeaker and improved magnetic motor for a loudspeaker.

A further object of the invention is to provide a motor of low impedance and high engine efficiency for driving a loudspeaker.

A still further object is to provide motor that eliminates the need for multiple magnets and expensive edge winding and offers greater freedom in amplifier matching for best overall system value.

Still yet further objects of the invention are to provide such motors as permit the construction of low voltage sound systems for portable sound or voice appliances like cell phones, note book and palm size computers, pagers, and other interactive, wireless or computer audio appliances.

SUMMARY OF THE INVENTION

One or more of the foregoing objects are attained in one aspect of the invention by a loudspeaker having a diaphragm with a voice coil disposed about its perimeter and extending in a gap into which the flux of a rare earth magnet is focused. The voice coil may have two or more windings that are connected in parallel. These may be layered on top of one another, so that the impedance of the coil, as well as its depth in the direction of motion, are low. The voice coil is preferably implemented using a polyamide form or bobbin, made for example, of circuit board material, which has patterned lead-in conductors embedded therein to bring power to the perimeter of the coil. The lead-in conductors connect at one end to wire windings wound on the bobbin, and extend at their other end to, or through, an opening located centrally behind the diaphragm, providing a robust ribbon input connection. The ribbon lead-in may be symmetrical, and the central opening further provides an air channel which may, for example, couple to an auxiliary chamber to further enhance the acoustic output. The magnet may be an annular or ring magnet, and it rests on a first, or lower, generally cup-shaped pole piece, that cooperates with a second, or upper generally washer-shaped pole piece to define the flux gap in a region extending around the perimeter of the diaphragm. Preferably, the upper surface of the washer is inclined radially inward to an edge of diminished thickness, to reduce central mass. This also provides added clearance at the front of the magnet assembly for accommodating the lead-in ribbon in a widely-curved arc without contact, and reduces the length of the central passage to prevent undesirable whistling when the diaphragm is subject to large displacement. The diaphragm may be domed to provide further clearance, and is weighted or mass-loaded by applying a material such as butyl rubber to lower its natural resonant frequency, thus extending its useful response band while providing sharp rolloff at the low end. Loading may be achieved by a sandwich construction, in which one face of the dome is entirely coated, and the rubber layer further extends in a band around the edge of the diaphragm to suspend the diaphragm to its housing. A flat diaphragm may also be used. Pole pieces may be formed of soft iron or low carbon steel, but materials such as chrome vanadium may be used to further reduce the thickness and weight of the overall construction without sacrificing the gains in efficiency and engine strength. The diaphragm may have a circular shape, or a rounded elongated contour, and the voice coil is a cylinder having, in cross-section, a corresponding contour. A magnetic fluid is selectively placed in the gap to enhance heat transfer and coil centering.

Further aspects of the invention provide motors as described above in which the coils are formed from wires that have round cross-sections.

Still further aspects of the invention provide motors as described above in which a first coil is disposed about a voice coil former and in which a second coil is disposed about the first coil.

The invention provides, in other aspects, a motor as described above which includes, as a magnetic field source, a permanent magnet and, more particularly, a permanent magnet that includes a rare earth metal. Related aspects of the invention provide a motor as described above in which the magnetic field source comprises neodymium. One such source is a neodymium boron iron magnet.

Another aspect of the invention provides a motor as described above in which the permanent magnet is ring shaped and provides air communication between the rear surface of the diaphragm and an auxiliary space.

Still other aspects of the invention provide a loudspeaker that includes a magnetic motor as described above.

These and other aspects of the invention are evident in the drawings and in the description that follows.

Loudspeaker magnetic motors as provided by the invention feature several advantages over the prior art. They provide a low cost, practical method for maximizing the available engine strength B $L^2/r$ in a small speaker with a rare earth magnet motor. This leads to an improved cost performance ratio by permitting construction of lower impedance, higher driving force and higher driving energy rare earth speaker motors for driving loudspeakers, providing sufficient energy for faithful operation at extended frequency range and offering greater freedom in amplifier matching for best overall system value.

BRIEF DESCRIPTION OF THE DRAWINGS

A more complete understanding of the invention may be attained by reference to the drawings, in which.

DETAILED DESCRIPTION OF THE ILLUSTRATED EMBODIMENT

By way of general background, the driving force available to a speaker is (B×L×I), where B is the flux density, L the length of coil wire and I the current through the coil wire. For a fixed magnet diameter and gap, the height d and thus the magnetic operating point B/H are rapidly reached where the flux density B in the gap increases very little, while the magnet cost increases as its height increases. The full energy product B*H can only be realized for B/H=1. For many applications, it is desirable to make a speaker quite small, and the magnet size, winding length or current capacity, as well as diaphragm displacement are all correspondingly diminished. However, the response of a speaker depends very much upon its natural oscillatory resonance, which is a function of its mass; there is also a trade-off between winding length and achievable current as the coil diameter gets smaller, and the ability to drive current through the coil may become limited by the coil inductance at higher frequencies. Furthermore, the magnitude and efficiency of low-frequency coupling to air depend on surface area and diaphragm displacement. These factors very much influence the achievable sound quality, or the practicality of driving the speaker with acceptable quality.

For a small speaker, the mass may be increased by loading the diaphragm, and low-frequency coupling may be enhanced by providing a longer-travel displacement, but increasing these parameters may require a thicker magnet to provide a deep gap of high field strength, thus raising speaker cost, and/or may require a higher power driver, thus limiting the potential areas of use for the speaker.

As a practical matter, is desirable for a general purpose broad range speaker for consumer electronics to have a substantially uniform response over the frequency range of several hundred Hz or less, to approximately twenty kHz. For many applications it is desirable that the entire speaker assembly including its housing occupy a relatively small space, for example with cross dimensions under ten centimeters and for many applications as small as several centimeters. As noted above, such size constraints would appear to impose contradictory design limitations for the achievement of broad-range uniform sound reproduction.

Figure 1:
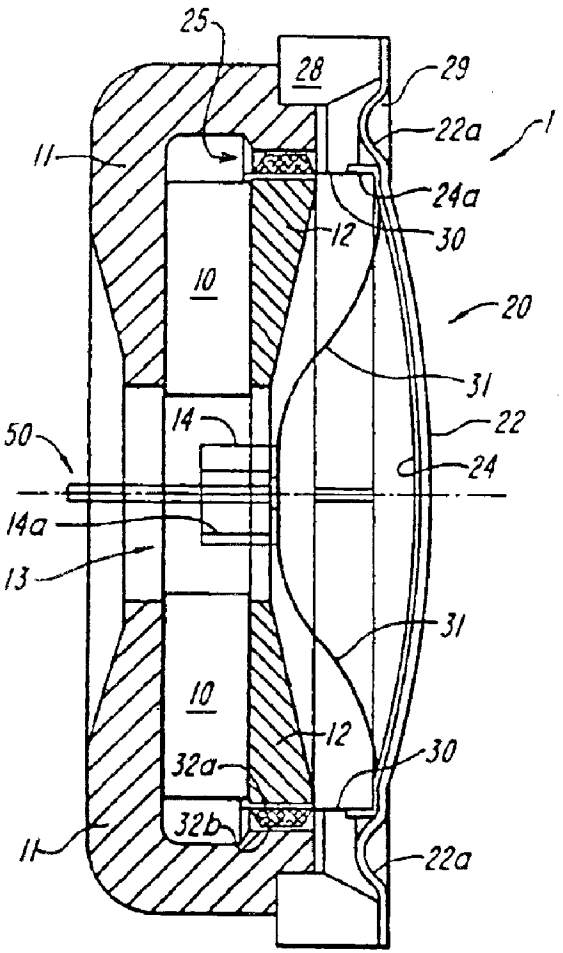
FIG. 1 is a cross-sectional view of a first embodiment of a speaker in accordance with the present invention.

The present invention addresses this problem by a speaker assembly 1 having a rare earth magnet assembly and a single small diaphragm connected to a voice coil that moves in a magnet field gap located around the perimeter of the diaphragm. An opening 13 is positioned centrally behind the diaphragm as shown in FIG. 1.

As shown, the speaker 1 of a representative embodiment includes a rare earth magnet 10 of generally annular and cylindrical form, which is secured between two pole pieces 11, 12 that are concentric therewith and are arranged to form a voice coil gap 25 that is positioned at the perimeter of the diaphragm 20. Pole piece 11 is a generally cup-shaped pole piece that constitutes the housing of the speaker, and the diaphragm 20 is secured to the front of the housing by a peripheral flange 28, to which it may be attached, for example with a rim piece 29. The diaphragm 20 is arranged concentrically with the annular magnet 10 and the gap 25.

The diaphragm assembly includes a body member 24 which may for example be a stamped or formed disk-like member made of a stiff material, e.g., aluminum or other metal, and a coating or mass loading layer 22 which increases the mass of the diaphragm assembly to lower its resonance. In a representative embodiment made with a diaphragm twenty-five millimeters in diameter, the mass was increased to approximately 1.5 grams, producing a natural resonance when suspended in the magnetic gap that was below about 200 Hz. Metals such as stainless steel or brass are also suitable. The layer 22 may be formed of a butyl rubber or the like, and may be attached to the layer 24 by co-molding against body member 24. Layer 22 damps or softens the quality of sound of the diaphragm, I addition to increasing the diaphragm mass to extend its low frequency range. As such, it may be applied to all or part of the diaphragm surface, and may be applied in lesser or greater thickness, depending upon the desired degree of mass loading and response. In the prototype embodiment with a 200 micrometer thick aluminum diaphragm body member of twenty five millimeters diameter, the layer 22 was of substantially equal mass, and entirely covered the surface to provide a composite assembly weighing 1.5 grams. The extension of the butyl rubber layer 22 in a band 22*a* about the perimeter serves as a flexible rolling suspension, that allows travel of the diaphragm in a direction normal to the flux gap without developing localized stresses in the suspension. Preferably, the polymer is a blend formulated to resist cracking, yet adhere well and add a suitable mass to the diaphragm.

The twenty-five millimeter diameter of the prototype diaphragm 24 corresponds in size to a relatively small tweeter or high frequency element. However, in accordance with a principal aspect of the present invention, speaker 1 achieves operation down to 200 Hz or below, and thus functions as a main, or broad range speaker, of uniform response over a major portion of the audio frequency band, e.g., in the frequency band 200–20,000 Hz. As such, it may be combined, e.g., with an identical one forming a two-channel pair, in a system with a compact sub-woofer, to form extremely compact, high fidelity surround sound system. For various applications, the magnet contruction and mass loading of the invention may be applied to diaphragms of 15–40 millimeter diameter, and most preferably about 17–35 millimeters to achieve a broad range miniature speaker for portable low voltage operation.

Figure 3:
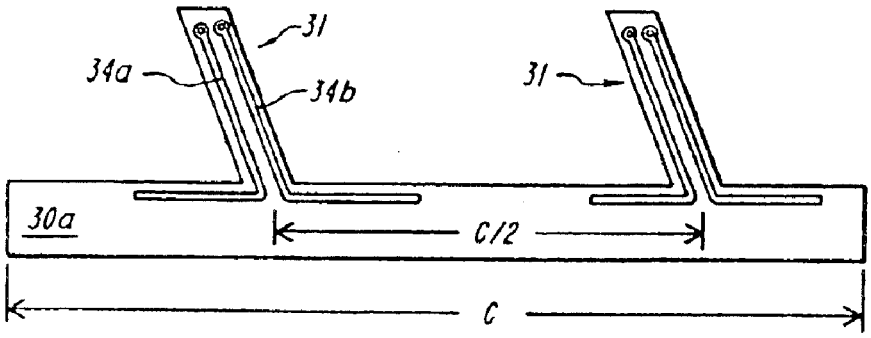

Continuing with the description of FIG. 1, a voice coil comprised of a polyamide bobbin or support 30 and wire wound coil or windings 32*a*, 32*b* is attached around the perimeter of the diaphragm 20, being cemented at one edge to a recessed flange 24*a* of the metal diaphragm 24 and extending into the gap 25. Preferably two parallel wire windings 32*a*, 32*b* substantially fill the width of the gap, and move back and forth approximately 2 millimeters to drive the diaphragm when the speaker is energized. The polyamide body 30 is preferably formed of material such as flex circuit board material, and, as described further below includes one or more lead-in extensions 31 having circuit conductors (shown in FIG. 3) formed therein for connecting between the wire windings 32*a*, 32*b* and a central access or terminal located at the opening 13 behind the center of the speaker. As shown in FIG. 3, the lead-in extensions 31 curve in a broad arc from the voice coil at the periphery, through the space behind the diaphragm 20, to the center.

In the illustrated embodiment 1, the diaphragm 20 is preferably dished or domed outwardly, providing a shape of enhanced stiffness and resistance to flexural mode excitation. This shape also acts effectively as a point-source acoustic radiator, allowing enhanced phase control of the sound transduced thereby. The upper pole piece 12 is tapered or angled inwardly back toward the center, so that it has relatively little mass in the central region and thus more efficiently concentrates flux in the gap. Both of these physical contours also provide spatial clearance behind the diaphragm 20 to permit both deflection of the diaphragm and enhanced clearance for the lead in connectors 31 to flex and move with the diaphragm without contacting surrounding structures. The lead in connector 31 may be soldered to a snap-in terminal block 14, which may be formed, for example, as a female jack connector, to which drive power from an external amplifier is supplied along the input drive lines 50, which in turn may connect to a corresponding male plug (not shown).

Advantageously, the entire speaker design is easily scale in size, to produce a broad range speaker smaller than one inch in total diameter or a speaker up to several inches in diameter. It is also adaptable to oblong or other shape diaphragms, which may be used to tailor the resultant output beam or sound distribution for particular environments or applications, such as automobile interiors, corner cabinets, or desktop units. Bandwidth is extended by one or more octaves, and the assembly involves fewer steps, each of which is readily mechanized for manufacturing efficiency.

Figure 2:
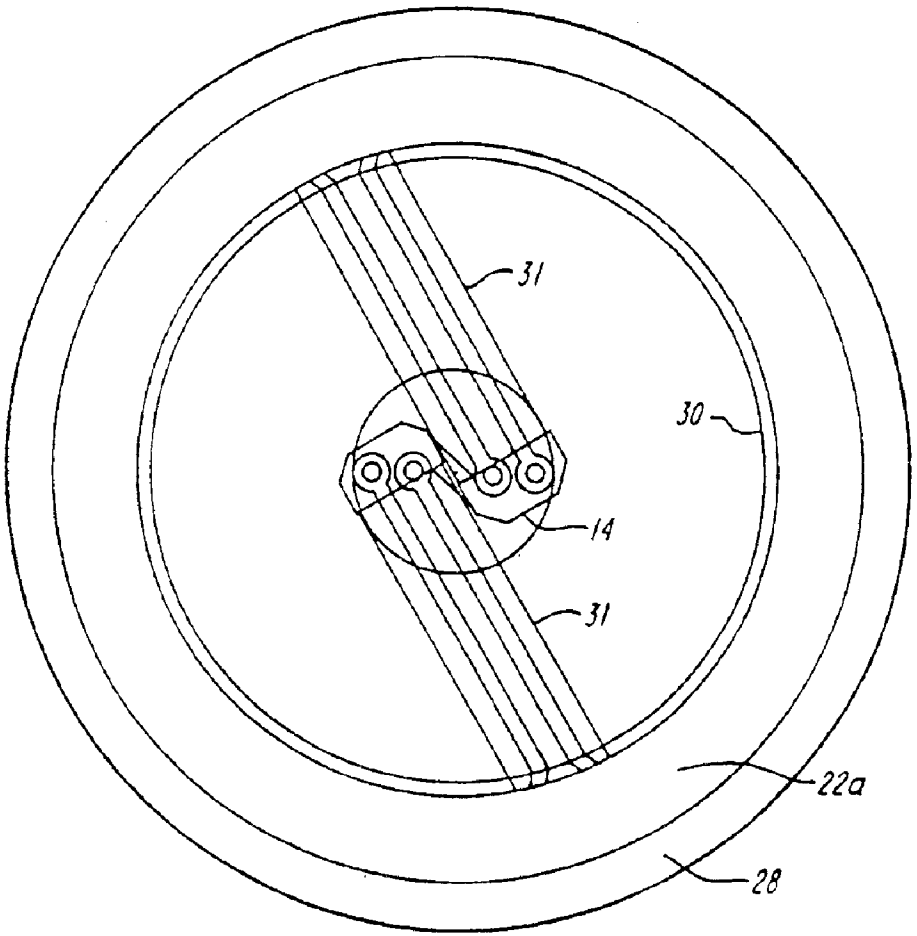
FIGS. 2 and 3 illustrate voice coil construction of the embodiment of FIG. 1.
Figure 3A:
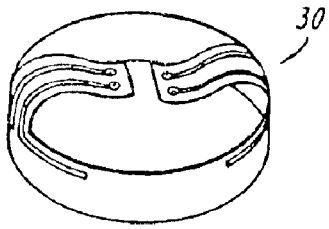
FIG. 3A is a perspective view of the coil support before assembly.
Figure 3B:
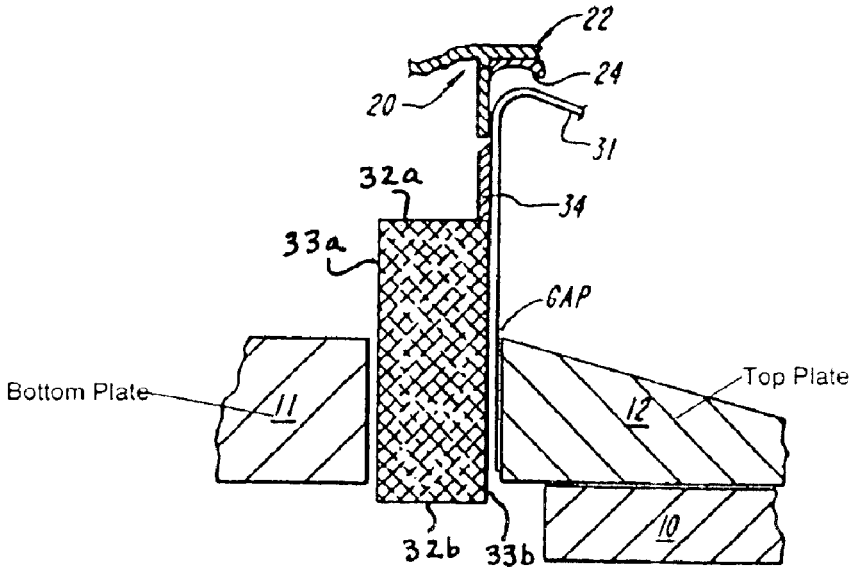
FIG. 3B is a sectional view showing the windings in the flux gap.

FIG 2 shows a front plan view of the perimeter voice coil mounted in the magnet assembly, but with the diaphragm structure omitted for clarity. FIG. 3 illustrates a plan view of the same bobbin assembly at an earlier fabrication stage, before forming into a cylinder and winding of the voice coils. In accordence with this aspect of the invention, the bobbin or coil support 30 is formed as a flat sheet or preform 30*a*, in a shape having a major body substantially or at least equal in length to the circumference of the diaphragm perimeter and the flux gap 25. The preform 30*a*, has extending arms 31 that each include patterned lead-in conductors 34*a*, 34*b* embedded therein. As shown the conductors 34*a*, 34*b* resemble conventional circuit board conductive lines and may be formed by a similar process, e.g., a lithographic etching process of a conductive metal film having a suitable current capacity, such as a copper foil. In the illustrated embodiment, the preform 30*a* has a length C equal to the perimeter circumference, and two lead-in projecting arms 31 are provided at a spacing C/2 for connecting drive power to the voice windings 32*a*, 32*b*. When the preform 30*a* is formed into a closed loop for the cylindrical bobbin, the arms 31 are diametrically opposite, as shown in FIG. 3A. This provides a symmetric and balanced centering suspension to further resist eccentric movement when the coil is subject to extreme levels of drive power. As further shown in FIG. 3B, the wire windings 32*a* 32*b* may be placed on top of each other to substantially fill the gap, while allowing a low-impedance high current voice coil to occupy a relative shallow region in the center of the gap so that the coil experiences a substantially uniform and high flux. By placing a small amount of a magnetic fluid 33*a*, 33*b*, such as a commercial ferrofluid, on the coil, the faces of the coil are maintained covered with a lubricating and protective film of liquid that also effectively couples flux for efficient actuation of the diaphragm. In other embodiments, the speaker may advantageously have three coils wound with two layers each and connected in parallel to provide lower inductance and lower impedance for improved operation with low voltage power bus equipment. In that case, three sets of lead-in traces are provided, which, as above, are preferably equispaced about the perimeter.

FIG. 2 shows a plan view from the face of the speaker showing the connection of the flexible lead-in ribbons 31 to the terminal strip or female jack connector 14 at the center of the speaker. As shown, the two conductors of each arm 31 connect to corresponding pin or pin connector located in the terminal block 14. One pin 14*a* of such a pin connector socket is illustrated in the side view of FIG. 1, and these are configured to connect to corresponding elements in a similar socket or plug connector attached to the input drive line 50, so that the speaker may be simply and removably connected to its drive power source of a consumer electronics unit in use.

Figure 4:
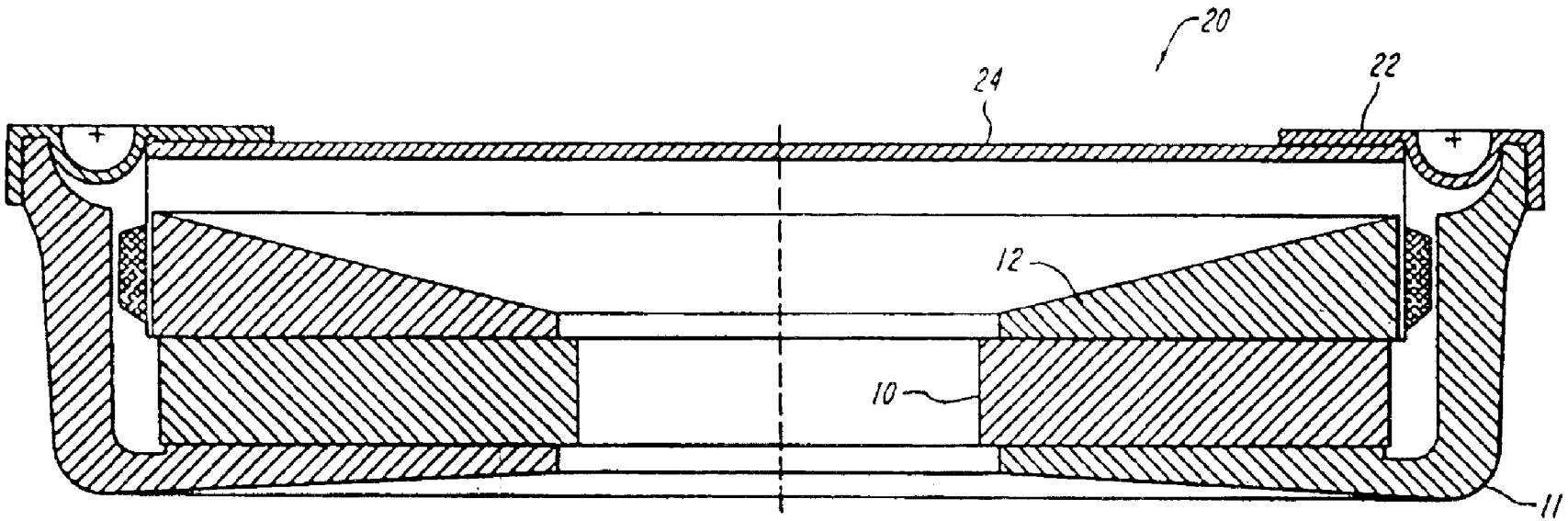
FIG. 4 shows a cross-sectional view through another embodiment of a speaker in accordance with the invention.

FIG. 4 illustrates another embodiment of a small, broad range speaker in accordance with the invention. Like components are numbered identically to those of FIG. 1. By way of scale, this embodiment has a total diameter of the lower pole piece equal to 31.6 millimeters, with a 26×0.04 mm stainless steel diaphragm of 5.5 square centimeter effective area. This construction specified a flat diaphragm, and rubber loading only in the perimeter and suspension band, with a total speaker height of 7.5 mm, a total weight of 22 grams, and a free air resonance of the suspended diaphragm of 180 Hz. Using a 7.5 gram magnet of Neodymium 40, a one-inch circular gap 2.5 mm high by 0.85 mm width, the speaker had a flux B in the gap of 1.1 Tesla, with a gap energy of 80 mWattsec. Two parallel copper wire windings 2.0 meters long carrying 7.5 watts provide effective drive force for a substantially linear response, with 20 dB drop-off points at 90 Hz and 22 kHz. In other embodiments, the system moving mass and suspension may e tuned to a system resonance as low as 100 Hz, and the multi-coil, multi-winding parallel design in a wide gap provides a high force, long excursion motor, that effectively provides high sound pressure over a broad frequency band. Moreover, the overall design provides a very low equivalent air volume Vas of about 20 cc, and damping Qts of about 0.3, allowing high fidelity operation in a very small enclosure. Moreover, the structurally stiff domed diaphragm of the first embodiment, and the damped metal diaphragm construction in general, provides a highly stable structure without extreme peaks of amplitude or phase response over the voice range, so that acoustic feedback suppression is readily implemented when the speaker is mounted in a device, such as a pager or cell phone, in close proximity to a microphone. The magnetic fluid which adheres to the coil and is constrained by field lines to remain in the gap provides an effective level of damping of voice coil movement, and the use of flexible copper traces for the voice coil lead-in lines leads to a very high reliability connection. The leads 34 may be stamped from a single sheet of polyimid/foil, and may be embedded between polyimid layers so they reside on the neutral or bending axis and are not subject to cracking, while handling continuous power as high as ten Watts in a one inch coil. The large central aperture allows efficient access for robotic assembly, and allow smooth and quiet airflow for various coupled enclosure assemblies. The wire voice coils may be wound in situ with a heat-curable adhesive to provide a light, rigid motor assembly for cylindrical, oblong or other coil/diaphragm shapes.

In addition to the basic broad range speaker design, the invention includes within its scope various embodiments of full range or surround sound systems wherein one or a pair of speaker as described above are employed in conjunction with a sub-woofer to provide a complete sound system having a response extending one to three or more octaves below that of the above-described speaker, yet be driven by a low-voltage source such as a class D amplifier 52 operating from a 3.3, 5, 6, or 12-volt power source. The full-range speaker may itself constitute a console, about the size of a conventional telephone handset, into which semiconductor electronics components have been incorporated, or into which a hand-held device such as a Palm Pilot, MP3 music file player or CD, tape or radio attaches to provide the audio signals which are amplified and played by the console.

Figure 5:
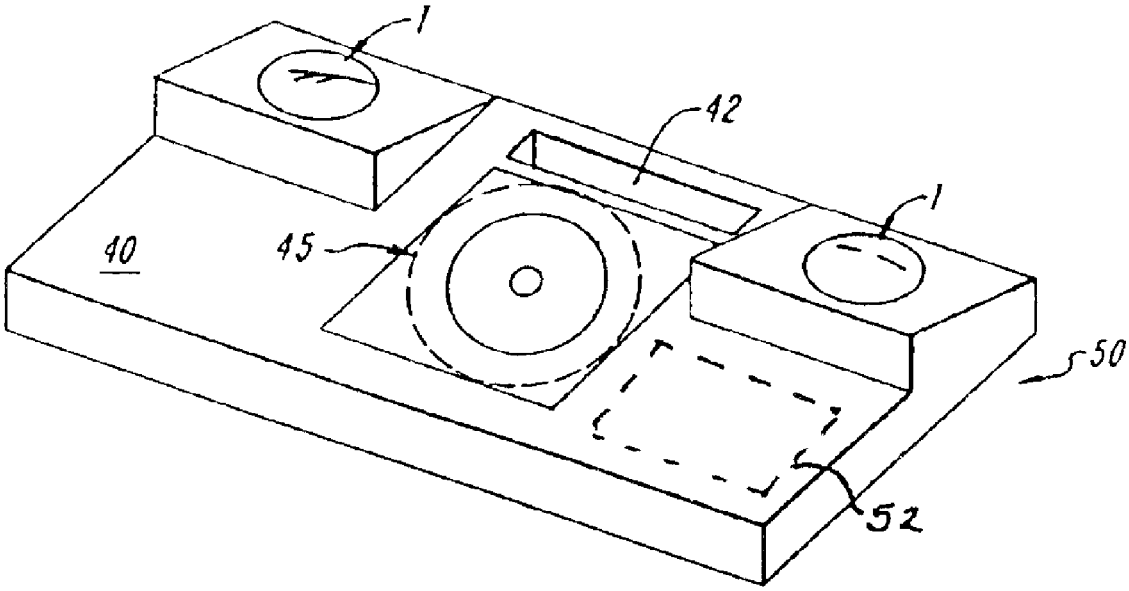
FIG. 5 illustrates a full-range system employing speakers of the invention with a sub-woofer in an integrated assembly.

FIG. 5 illustrates such a sound system 50. As shown, a pair of small broad range speakers 1 as described above are mounted in a small base unit 40, which may, for example be a desk-top box comparable in size to a telephone or disk drive. The speakers are connected to transduce separate, e.g., left and right sound channels, and a sub-woofer 45 is mounted in a vented recess to transduce low frequency audio. The sub-woofer may be implemented with a substantially similar, but larger diameter design, or a more conventional cone diaphragm construction of larger diameter. With suitable weighting and suspension, this may be as small as a 55–125 millimeter diameter speaker. The box 40 includes a bay or recess 42 to hold the radio, MP3 device, Palm storage or communications device, or other audio source, and this recess may be a docking recess. In that case, the box 40 preferably includes a suitable charger, optical data coupler and/or other docking support structure for coupling with the intended source device or devices. The box 40 may also contains a suitable network or modem device, conversion circuitry, and amplification circuitry, so that it both charges or powers the audio source device and provides audio amplification or communication support for audio data stored in the device.

The above described embodiments of an improved magnetic motor, loudspeaker and systems utilizing a loudspeaker according to the invention are intended to be exemplary only, to provide a basic understanding of the operative principles and the intended implementations of the new speaker and systems. It will be appreciated that the embodiments shown in the drawings and described above are merely examples of the invention and that other motors, loudspeakers and systems incorporating the teachings hereof are within the scope of the invention, as set forth in the claims hereafter and equivalents thereof.

What is claimed is:

1. A loudspeaker comprising:

a diaphragm;

a rare earth magnet arranged to define a flux gap in a perimeter region of the diaphragm;

a voice coil, wherein the voice coil comprises a cylindrical polymer bobbin having lead-in conductors coupled thereto, and wire windings extending around the cylindrical bobbin, wherein the wire winding comprise two or more conductors coupled in parallel, and wherein the wire windings are connected to said lead-in conductors forming a low impedance voice coil and the lead-in conductors extend from said perimeter region to provide a flexible connection to an input drive signal; and at least one flexible arm comprising a polymer, wherein that arm is coupled to and extends from said cylindrical polymer bobbin, said at least one said lead-in conductor being embedded in said arm.

2. The loudspeaker of claim 1, wherein the wire windings are connected in parallel and layered on top of one another.

3. The loudspeaker of claim 2, wherein the coils comprise wires having round crosssections.

4. The loudspeaker of claim 2, in which the magnet is a ring magnet and the lead-in connectors connect through a central opening in the magnet.

5. The loudspeaker of claim 4, wherein the flux gap is defined by a first pole piece forming a generally cup-like housing contacting a first side of the magnet, and a second pole piece contacting an opposite side of the magnet to position and focus magnetic flux as a substantially uniform field across said gap in the peripheral region.

6. The loudspeaker of claim 5, wherein the first and second pole pieces each have a central aperture therein.

7. The loudspeaker of claim 1, wherein the diaphragm has a diameter between approximately 0.7 and 1.5 inches.

8. The loudspeaker of claim 7, wherein the diaphragm is a shaped metal diaphragm having a mass loading layer on its surface.

9. The loudspeaker of claim 8, wherein the mass loading layer substantially doubles the mass of the diaphragm to shift its resonance below several hundred Herz.

10. The loudspeaker of claim 1, further comprising an air passage positioned centrally behind the diaphragm and communicating with an auxiliary acoustic space.

11. The loudspeaker of claim 1, wherein the wire windings comprise two or more wire coils connected in parallel and layered on top of one another to substantially fill the flux gap.

12. The loudspeaker of claim 11, further comprising a magnetic fluid restrained by flux to reside in the flux gap for effective thermal transfer from the coils.

13. The loudspeaker of claim 1, wherein the rare earth magnet contains neodymium.

14. The loudspeaker of claim 13, wherein magnet is a neodymium boron iron ring magnet.

15. A loudspeaker system comprising at least one broad range speaker, each such broad range speaker including a diaphragm having a diameter between about 15 and 40 millimeters and a polymer coating effective to suspend the diaphragm with a resonance below about 200 Hz;

a rare earth magnet arranged to define a flux gap in a perimeter region of the diaphragm; and a voice coil comprising a cylindrical polymer bobbin, and having wire windings in said gap and connected to drive the diaphragm down to resonance, wherein the wire windings comprise two or more conductors coupled in parallel, and wherein the wire windings are connected to lead-in conductors that extend between said perimeter region and a central aperture positioned behind the diaphragm; and said system further includes a sound system housing a subwoofer effective with said at least one broad range speaker to form a full range system, and at least one flexible arm comprising a polymer, wherein that arm is coupled to and extends from said cylindrical polymer bobbin, said at least one said lead-in conductor being embedded in said arm.

16. The loudspeaker system of claim 15, wherein the sound system housing includes a docking recess for an audio source and at least one class D amplifier for apply the audio source as an amplified drive signal to the speakers.

17. A loudspeaker comprising:

a diaphragm having a diameter between about 15 and 40 millimeters and a polymer coating effective to suspend the diaphragm with a resonance below about 200 Hz;

a rare earth magnet arranged to define a flux gap in a perimeter region of the diaphragm; and voice coil comprising a cylindrical polymer bobbin, and having wire windings in said gap and connected to drive the diaphragm down to resonance, wherein the wire windings comprise two or more conductors coupled in parallel, and wherein the wire windings are connected to lead-in conductors that extend between said perimeter region and a central aperture positioned behind the diaphragm, and at least one flexible arm comprising a polymer, wherein that arm is coupled to and extends from said cylindrical polymer bobbin, said at least one said lead-in conductor being embedded in said arm.

* * * * *